US008215165B2

(12) United States Patent
Giurintano et al.

(10) Patent No.: US 8,215,165 B2
(45) Date of Patent: Jul. 10, 2012

(54) TORSO SIMULATOR FOR BALLISTICS TESTING

(75) Inventors: David Giurintano, Baton Rouge, LA (US); Ryckman Callais, Lafayette, LA (US); John Paul Cancienne, Baton Rouge, LA (US); Jeffrey Lousteau, Houtson, TX (US); Jay Tumlin, Breaux Bridge, LA (US)

(73) Assignee: Ultimate Ballistics Box, LLC, Baton Rouge, LA (US)

( * ) Notice: Subject to any disclaimer, the term of this patent is extended or adjusted under 35 U.S.C. 154(b) by 241 days.

(21) Appl. No.: 12/767,009

(22) Filed: Apr. 26, 2010

(65) Prior Publication Data

US 2010/0269581 A1 Oct. 28, 2010

Related U.S. Application Data

(60) Provisional application No. 61/173,003, filed on Apr. 27, 2009.

(51) Int. Cl.
*G01L 5/14* (2006.01)

(52) U.S. Cl. ..... 73/167; 273/410

(58) Field of Classification Search ..... 73/167
See application file for complete search history.

(56) References Cited

U.S. PATENT DOCUMENTS

| | | | | |
|---|---|---|---|---|
| 523,510 | A | 7/1894 | Brunswig | |
| 4,804,325 | A * | 2/1989 | Willits et al. | 434/22 |
| 5,020,157 | A * | 6/1991 | Dyer | 2/2.5 |
| 5,357,796 | A * | 10/1994 | Jamison | 73/167 |
| 5,531,113 | A * | 7/1996 | Jamison | 73/167 |
| 5,850,033 | A | 12/1998 | Mirzeabasov et al. | |
| 6,769,286 | B2 * | 8/2004 | Biermann et al. | 73/12.01 |
| 7,222,525 | B1 | 5/2007 | Jones | |
| 7,421,893 | B1 * | 9/2008 | Mann et al. | 73/167 |
| 2003/0066365 | A1 * | 4/2003 | Biermann et al. | 73/866.4 |
| 2004/0067591 | A1 * | 4/2004 | Madsen et al. | 436/8 |

* cited by examiner

*Primary Examiner* — Andre Allen
(74) *Attorney, Agent, or Firm* — Warner J. Delaune; Baker Donelson, et al.

(57) ABSTRACT

A device for simulating the torso of an animal or human to determine projectile performance is provided, comprising a support frame; and a plurality of selectively removable simulant inserts, including a hide simulant insert, a muscle simulant insert, a bone simulant insert, and one or more internal organ simulant insert, and wherein the simulant inserts are placed within the support frame in a predetermined order specific to the type of animal or human being simulated. The support frame includes a mounting device to secure the support frame to a ground surface, and a base adapted to orient the support frame at a selectable angle relative to a projectile path. The support frame further includes a locking device adapted to secure the simulant inserts to the support frame. In a preferred embodiment, the locking device includes a fastener slidably disposed within a slot formed in the support frame, and an extended member adapted to contact one of the simulant inserts.

17 Claims, 12 Drawing Sheets

TORSO SIMULATOR FOR BALLISTICS TESTING

CROSS-REFERENCE TO RELATED APPLICATIONS

This nonprovisional patent application claims priority under 35 U.S.C. §119 to U.S. Provisional Application Ser. No. 61/173,003, filed on Apr. 27, 2009.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON COMPACT DISC

Not applicable.

BACKGROUND OF THE INVENTION

1. Field of the Invention

The present invention relates to devices used to assess the penetrative performance characteristics of projectiles, and more particularly to such devices for simulating the anatomical features of game animals.

2. Description of Related Art

Big game hunting is an exhilarating sport enjoyed by many enthusiasts around the world. According to the 2001 National Survey of Fishing, Hunting and Wildlife-Related Recreation, there are approximately 11 million big game hunters in the United States that spend $6.5 billion on hunting related equipment annually. Big game is most often taken with rifles, although large caliber pistols, shotguns, and archery equipment are also commonly used. The best way to prepare for big game hunting and ensure one's success in bringing down these large animals is to know how the projectile, e.g. the bullet or arrow, will perform when shooting the intended game animal.

There are a wide variety of shooting targets and ballistic methodologies used to test projectile performance. Some of the more popular targets are wet pack (water soaked newspaper), ballistic gelatin, water filled tanks, and metal sheets. All of these shooting targets are deficient for various reasons when trying to accurately simulate a projectile's damage on a living animal. A common shortcoming with each target is the lack of a full "shoulder to shoulder" representation.

Specifically, none of these existing targets comprise a heterogeneous stacked mixture of materials having properties similar to their biologic counterparts, leaving the hunter with insufficient knowledge of how the projectiles would perform on a live animal. Animals are composed of hide, muscle, bone, and internal organs. All of these tissues must be accounted for to accurately predict projectile performance using a mechanical model.

Shooting enthusiasts are often limited in the resources they can devote to effectively testing projectile incapacitation on game animals. Therefore, cost effective devices and methods are of great interest to these hunters. However, inexpensive devices generally fail to deliver the reliable simulation results required, because their simple structures do not provide accurate analogs to anatomical tissues. Moreover, a projectile's mechanical behavior varies significantly with respect to its penetrating medium. For example, modeling a 30-inch wide Cape buffalo by using only thirty inches (30") of ballistic gelatin will not provide the user an accurate simulation of real life bullet performance. Since the gelatin block does not incorporate a bone simulant, the bullet's expansion, deceleration, and fragmentation results cannot be regarded as reliable. Many people continue to use these homogeneous targets strictly because better alternatives do not exist. Therefore, prediction of projectile performance on a live animal remains speculative, calling into question the use of such unreliable methods from the start.

U.S. Pat. No. 7,222,525 to Jones discloses a device for testing bullet penetration, however, it does not provide a means for keeping the gelatin block from moving after impact from the bullet. Furthermore, the device does not account for the effect of hide, bone, or internal organs on the projectile. Importantly, ballistic gelatin can only be used to simulate muscle, not internal organs. The specific gravity and mechanical properties of muscle are different than internal organs, because internal organs contain more liquid and gases.

U.S. Pat. No. 523,510 to Brunswig discloses a tank system to measure projectile penetration. Similar to most other penetration testing devices, that invention does not take into account the effect of bone or hide on the projectile's performance.

U.S. Pat. No. 5,850,033 to Mirzeabasov, et al., most closely replicates one half of a torso of a human. However, even if this device were employed, one could not predict the effect of a shoulder-to-shoulder shot on a big game animal. In order to determine the distance of penetration, the device must effectively be destroyed to find the end point of the projectile's path. Similar to Jones, the device does not provide a means for remaining in place at impact. Moreover, it does not provide selectively removable inserts to discern penetration depth or any simulant for internal organs.

Thus, none of the previously described devices take into account all four of the heterogeneous materials that would be penetrated by a projectile for a shoulder-to-shoulder shot on a big game animal. What is needed, therefore, is a torso simulation device for projectile performance testing which includes mechanical analogs or simulants for all anatomical tissues. It should enable quick and easy discernment of penetration depth and wound cavity by using selectively removable inserts that can be replaced for each test. The device should permit the installation of varying inserts and materials to closely approximate the actual width and specific gravity of a wide range of animals, including deer, elk, bear, eland, buffalo, and other big game. The device should also be a stable platform capable of withstanding movement in response to the high energy impact of a projectile, such as a rifle bullet or arrow. Finally, it should be relatively compact, portable, and simple to maintain in consideration of the distances required for testing in potentially remote locations.

SUMMARY OF THE INVENTION

Therefore, a device for simulating the torso of an animal to determine projectile penetration performance is provided, comprising a support frame; and a plurality of selectively removable simulant inserts, including a hide simulant insert, a muscle simulant insert, a bone simulant insert, and one or more internal organ simulant inserts, and wherein the simulant inserts are placed within the support frame in a predetermined order specific to the type of animal being simulated.

The support frame includes a mounting device to secure the support frame to a ground surface, as well as a base adapted to orient the support frame at a selectable angle relative to a projectile path. The support frame further includes a locking device adapted to secure the simulant inserts to the support frame. In a preferred embodiment, the locking device includes a fastener slidably disposed within a slot formed in the support frame, and an extended member adapted to contact one of the simulant inserts.

The hide simulant insert is preferably comprised of one or more sheets of real or imitation leather secured to a hide simulant frame.

The muscle simulant insert is preferably comprised of ballistic gelatin media.

The bone simulant insert is preferably comprised of one or more sheets of fiberglass.

The internal organ simulant inserts are preferably comprised of one or more liquid inserts and one or more air inserts. The liquid insert comprises a flexible container containing a liquid, such as water or other contents approximating the internal organs, and wherein the flexible container is secured to a liquid insert frame. The liquid insert frame includes at least one hole formed therein to permit liquid from the flexible container to flow away from the support frame after penetration by a projectile. The air insert comprises an air insert frame having a front side and a back side, and wherein a flexible sheet, such as a polyethylene sheet, is secured to the front side and the back side of the air insert frame.

In a preferred embodiment, the simulant inserts within the support frame approximate the width of the animal being simulated.

In another embodiment, the average specific gravity of the internal organ simulant inserts approximates the specific gravity of the internal organs of the animal being simulated.

Preferably, the simulant inserts are placed within the support frame in the following order: a first hide simulant insert; a first muscle simulant insert; a first bone simulant insert; one or more internal organ simulant inserts; a second bone simulant insert; a second muscle simulant insert; and a second hide simulant insert. Also, the internal organ simulant inserts are preferably comprised of one or more liquid inserts and one or more air inserts, and wherein the number and sequence of the liquid inserts and the air inserts are chosen to approximate the specific gravity and width of the animal being simulated.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
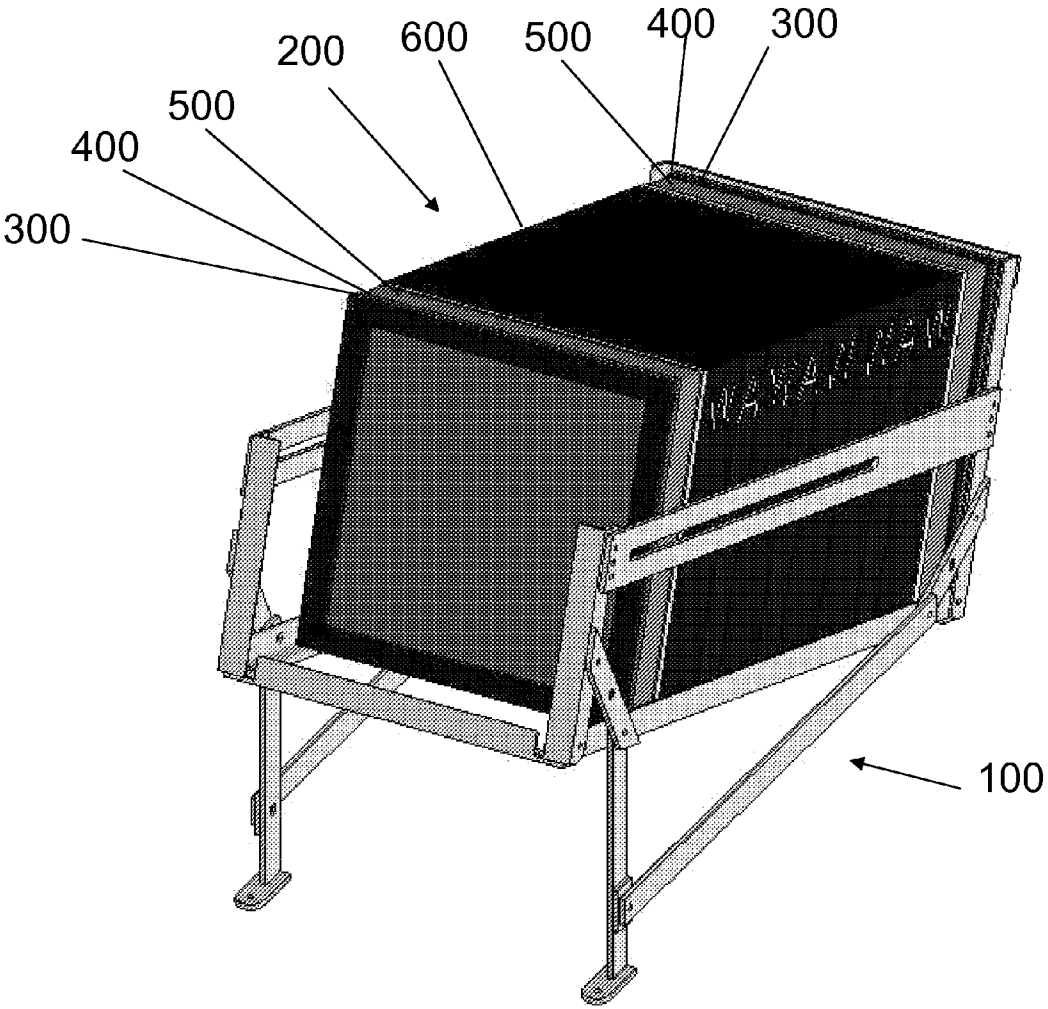
FIG. 1 shows a fully assembled view of a preferred embodiment of the present invention.

Turning now to FIG. 1, a preferred embodiment of the present invention, a torso simulator for ballistics testing, is illustrated. References in this description to projectiles includes any type of bullet fired by a firearm (such as handguns, rifles, and shotguns), projectiles used for military or law enforcement purposes, and projectiles used in archery equipment, such as arrows. When the term "projectile performance" is used herein, we mean an assessment of the projectile's penetration results, as well as trauma or other effects to other layers which have not been penetrated. For example, non-penetrated layers may be subject to cracking, bursting, or other perceptible deformations which are analogous to actual anatomical bruising, cracked or broken bones, or ruptured organs due to hydrostatic shock from projectile impact.

The fully assembled device comprises a support frame 100, and a plurality of selectively removable simulant layers or inserts 200, including a hide simulant insert 300, a muscle simulant insert 400, a bone simulant insert 500, and one or more internal organ simulant inserts 600. As will be explained in further detail below, the simulant layers or inserts 200 are placed within the support frame 100 in a predetermined order specific to the type of animal being simulated. The simulant inserts 200 simulate the hide, muscle, bone and internal organs of a big game animal, such as a whitetail deer, elk, grizzly bear, eland or cape buffalo.

Figure 2:
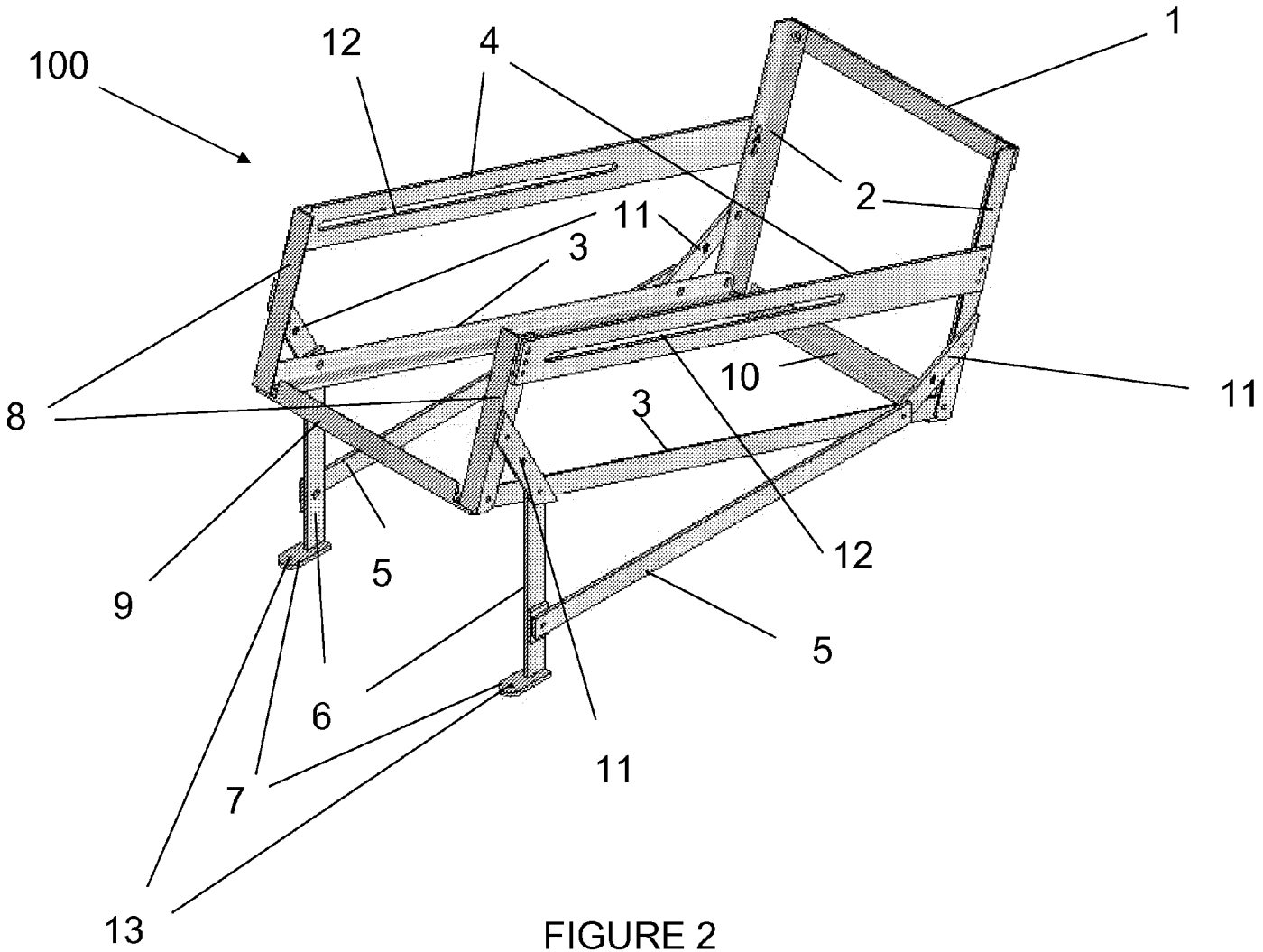
FIG. 2 shows a frame used in connection with the embodiment of FIG. 1.

The frame is best depicted in FIG. 2 and is preferably constructed from 6061-T6 and 6061-T6511 aluminum grades, although similar metals of equivalent properties may also be employed. The frame 100 includes a rear top support 1, rear upright supports 2, bottom rails 3, side rails 4, front upright supports 8, front rail 9, and rear rail 10, all rigidly attached to form the static structure of the frame 100 as depicted in FIG. 2. Corner braces 11 add additional stability to the frame 100. Front legs 6 are attached to bottom rails 3 and reinforced by support members 5 to lift the frame 100 at a predetermined angle in the manner to be explained further herein. A mounting device in the form of feet 7 can be welded to the front legs 6 to ensure stability upon impact of a projectile through the inserts 200. If necessary, additional stability can be obtained by driving long nails or other anchoring spikes into the ground through holes 13 formed into feet 7.

Figure 9:
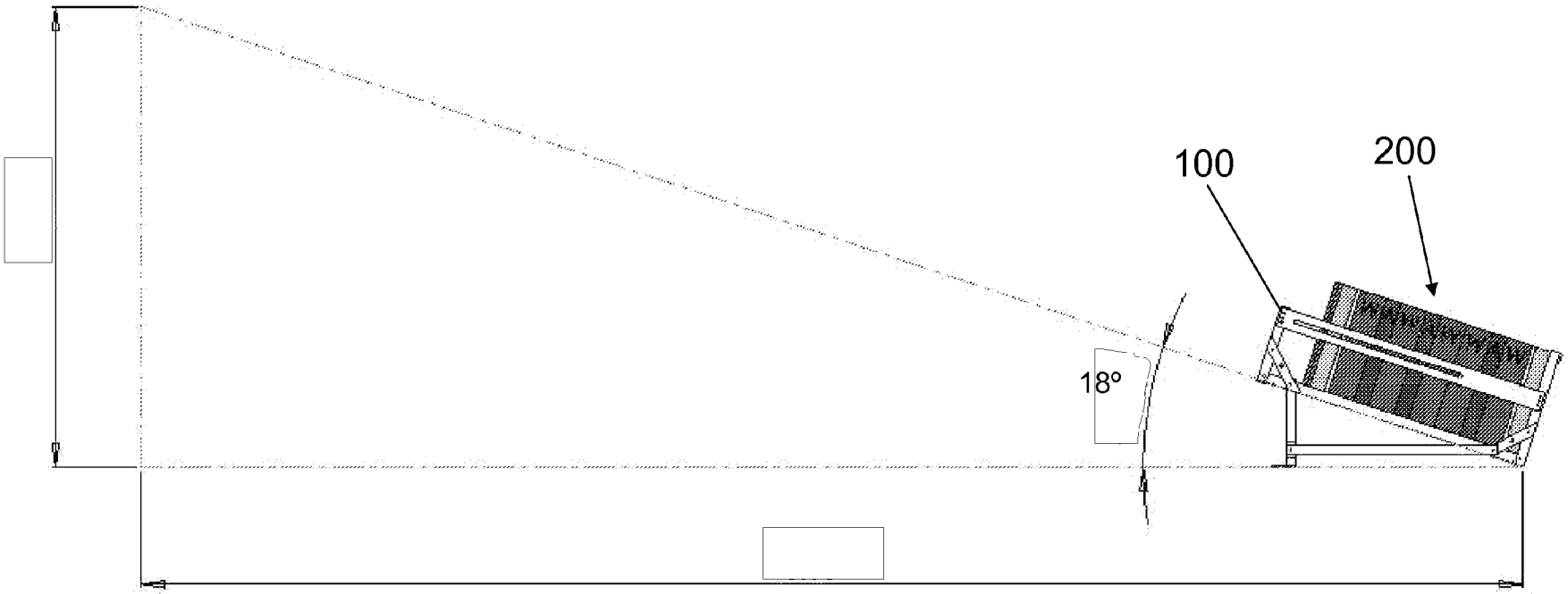
FIG. 9 shows a schematic diagram of a preferred orientation of the frame immediately prior to testing.

The preferred frame consists of both structural angles rectangular bar stock. For the frame to fit inside a standard shipping tube, the components of the frame 100 are connected to one another by machine screws, lock washers, and nuts in a manner known to those in the art. As shown in FIG. 9, the length of legs 6 causes the frame to be tilted about 15° to 20° from horizontal so that a projectile will penetrate normal to the frontal area. If complete penetration occurs, the projectile will harmlessly entire the ground. It should be understood that the frame 100 can be tilted at any desired angle to suit the weapon and the particular exterior ballistics of the projectile so that the path of travel through the inserts 200 is substantially parallel to the frame 100.

Figure 3:
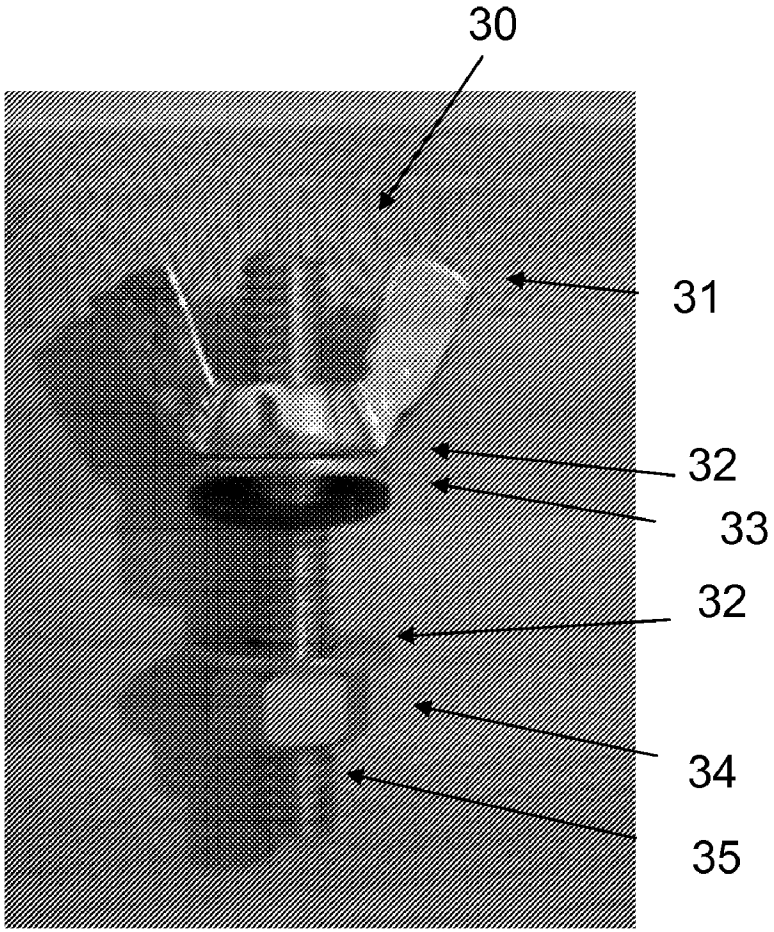
FIG. 3 shows a locking device used to secure inserts within the frame.

A locking device 30 to secure the position of the inserts 200 within the frame 100 is shown in detail in FIG. 3 and preferably comprises a threaded shaft 35, two metal washers 33, one rubber flat washer 32, one hex nut 34, and one wing nut 31. Two locking devices 30 resides within respective slots 12 which are formed along the length of side rails 4. When engaged, locking devices 30 contact the outermost hide simulant insert 300 to prevent movement of the inserts 200 relative to one another.

The shoulder to shoulder representation of the animal of choice (whitetail deer, elk, grizzly bear, eland or Cape buffalo) is made up of layers of materials to represent their biologic analogs. These biologic analogs will be represented twice, with the exception of the internal organs section, in order to replicate the entire width of the animal. The layers in the preferred embodiment are standardized as a 15"×15" frontal area. Frontal area may be made smaller as long as the wound cavity does not exceed it. If made too small, then edge effects of the wound cavity would be created, corrupting the results. The thickness of each layer of tissue is a direct correlation to the actual biologic tissues of the big game animals simulated.

Figure 4A:
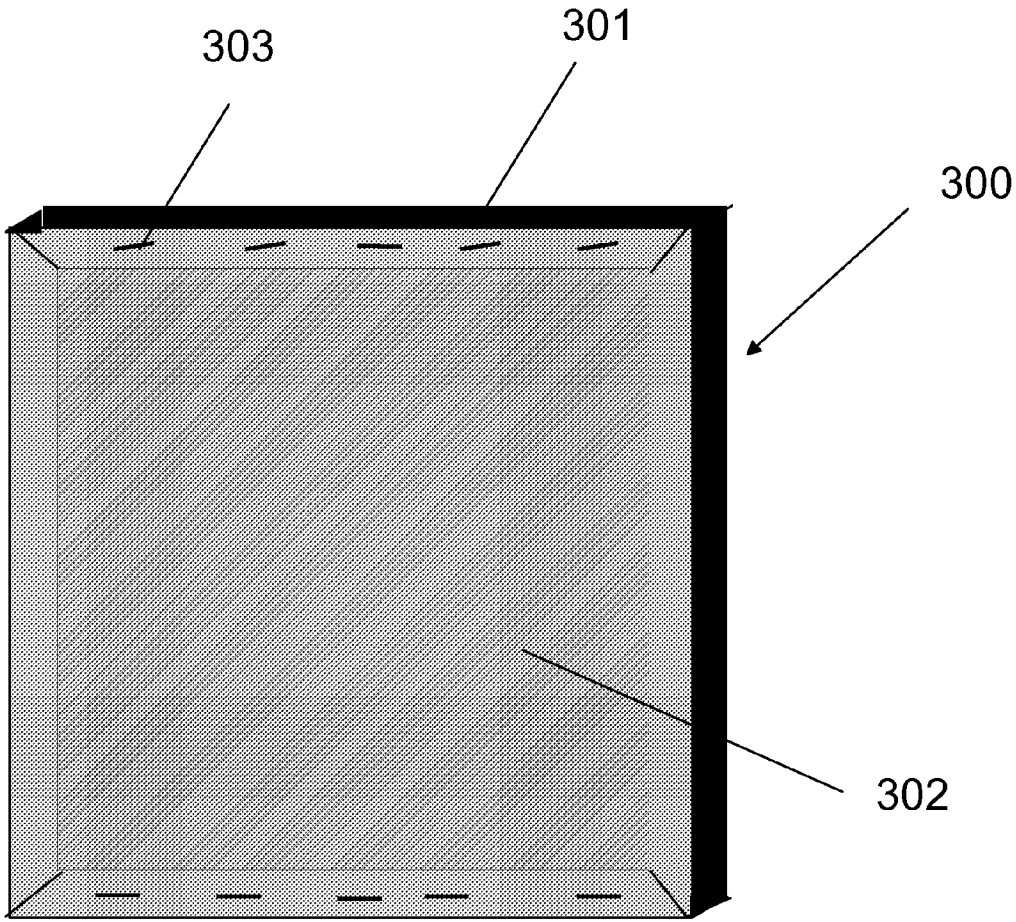
FIGS. 4A and 4B show detailed views of the hide insert.
Figure 4B:
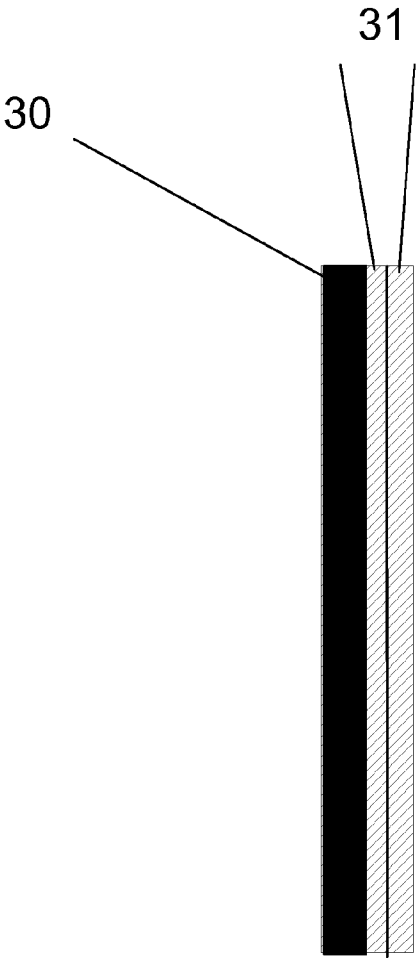

The insert closest to the front of the frame 100 simulates the hide of the animal. As shown in FIGS. 4A and 4B, the hide simulant insert 300 is constructed from a hide frame 301 made of pine boards and a hide simulant 302 made of real or imitation leather. The hide simulant 302 is stretched over the wooden frame 301 and attached with staples 303. The appropriate thickness of hide should be modeled by layering the hide simulant 302 a specified number of times. For example, Table 1 defines the appropriate number of layers of hide simulant to correlate to the thickness of each animal's hide.

TABLE 1

Anatomically Correct Hide Thickness and Required Number of Hide Simulant Sheets.

| | Whitetail Deer | Elk | Grizzly Bear | Eland | Cape Buffalo |
|---|---|---|---|---|---|
| Animal Hide Thickness (in) | 0.25 | 0.3 | 0.4 | 0.3 | 0.48 |
| No. of Hide Simulant Sheets | 4 | 5 | 6 | 5 | 8 |

Figure 5:
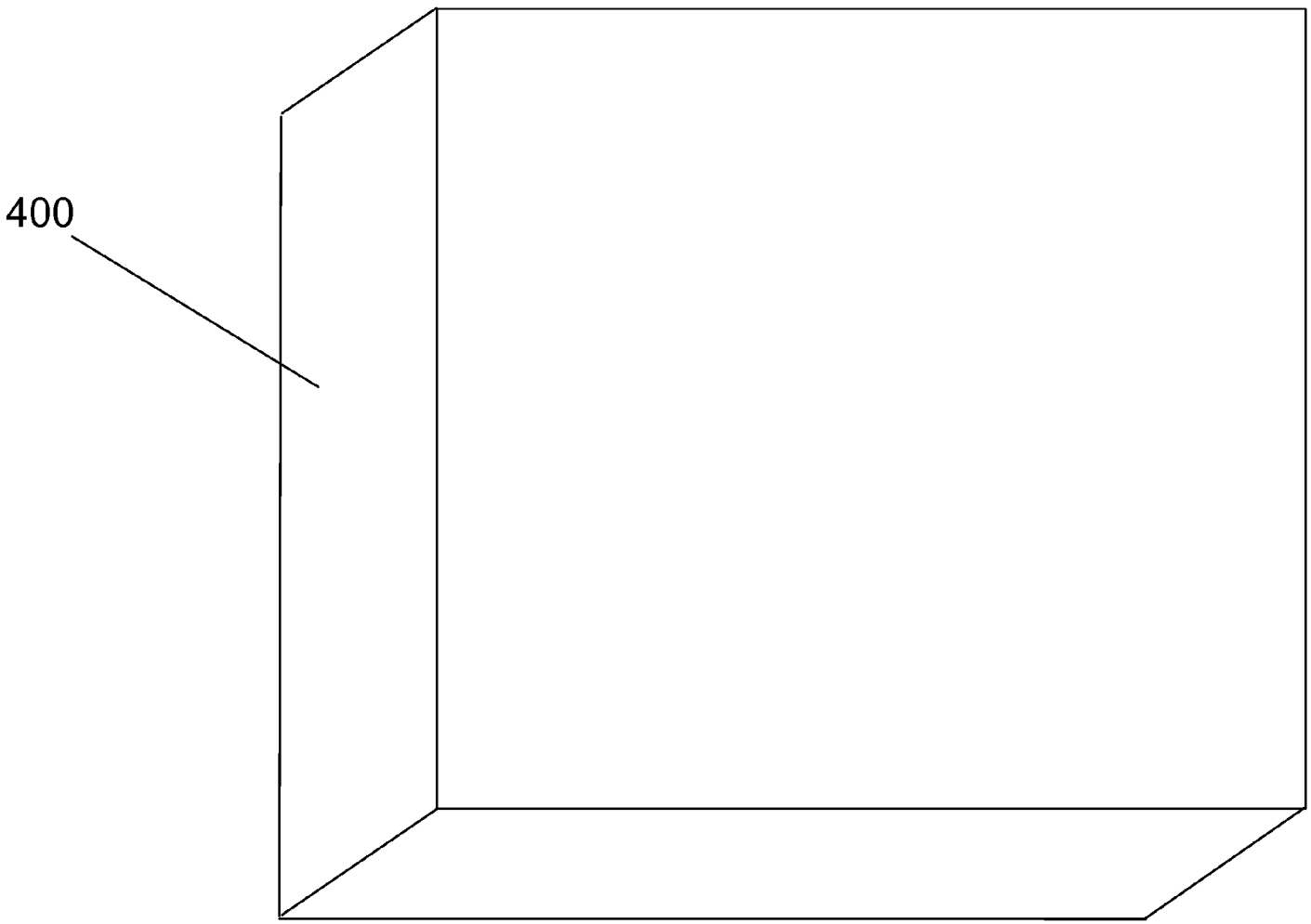
FIG. 5 shows a detailed view of the muscle insert.

The muscle simulant insert 400, shown in FIG. 5, is constructed from a molded 15"×15" slab of Corbin SIM-TEST™ ballistic gelatin with a thickness (0.5"-2.0") appropriate to replicate the muscle thickness of each of the five target species. Corbin SIM-TEST™ is an animal protein based muscle tissue simulation media for bullet performance testing. This material is an extremely close match to muscle tissue in density and consistency. It does not require refrigeration and can also be melted and re-cast an unlimited amount of times.

Table 2 defines the appropriate thickness of muscle simulant insert to provide a one to one correlation of muscle to the muscle simulant. The numbers in Table 2 are based on one side of the animal. Therefore, two layers of muscle simulant will be needed to simulate the complete width of the animal.

TABLE 2

Anatomically Correct Muscle Thickness and Required Thickness of Muscle Analog

| Thickness (in) | Whitetail Deer | Elk | Grizzly Bear | Eland | Cape Buffalo |
|---|---|---|---|---|---|
| Animal Muscle | 0.47 | 1.21 | 1.4 | 1.65 | 2.08 |
| Muscle Simulant Insert | 0.5 | 1.25 | 1.5 | 1.5 | 2 |

Figure 6:
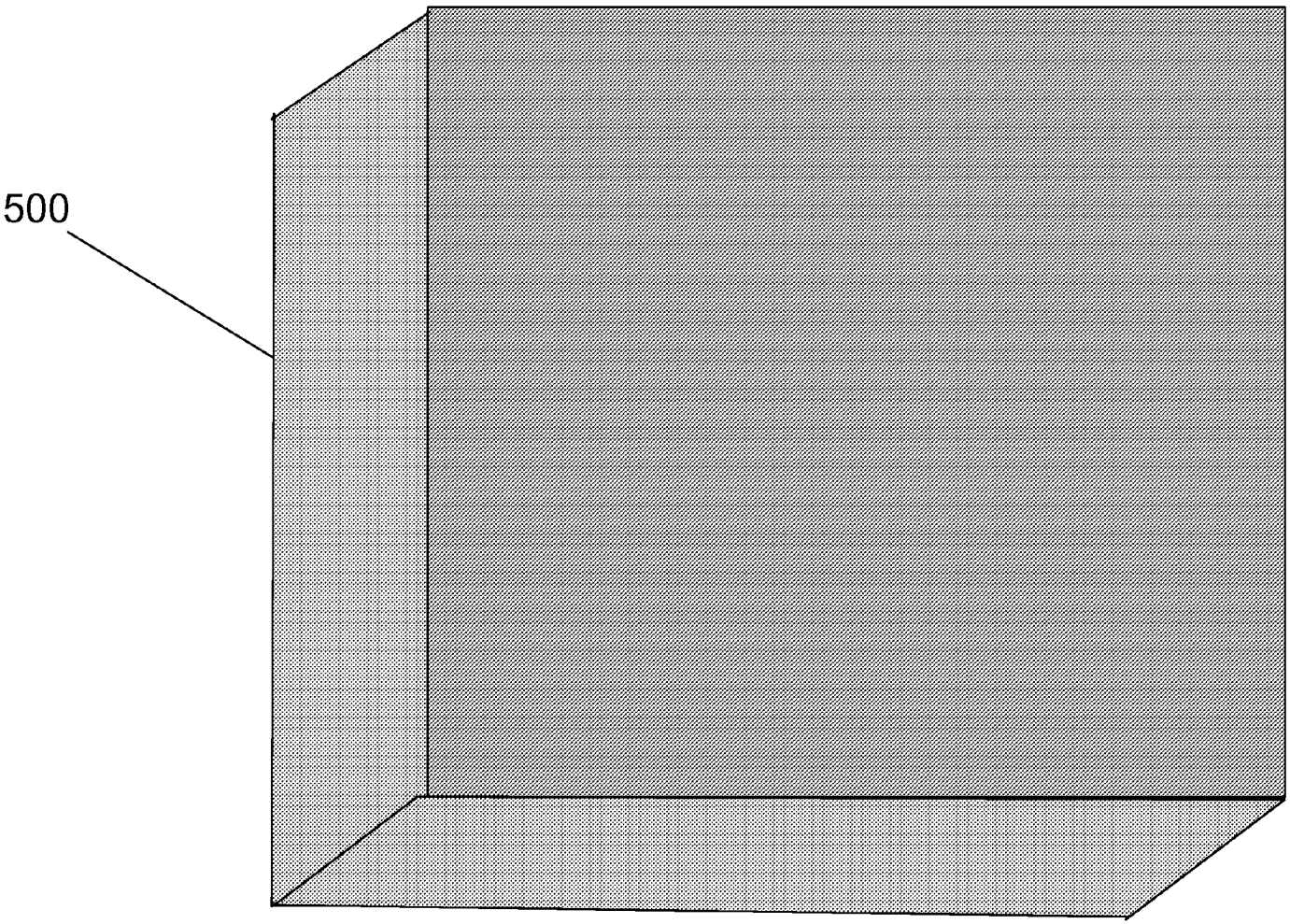
FIG. 6 shows a detailed view of the bone insert.

The preferred construction of the bone simulant insert 500, shown in FIG. 6, is a fiberglass sheet. The fiberglass sheets are created from a ¾ ounce woven fiber mat and saturated with a 3:1 epoxy hardener. They have a thicknesses range from 0.125"-0.5". Bone simulant insert 500 properties can be manipulated to the approximate properties of bone by adjusting the epoxy ratio of resin to hardener and the type of the fiber mat used.

TABLE 3

Anatomically Correct Bone Thickness and Required Thickness of Bone Simulant Insert

| Thickness (in) | Whitetail Deer | Elk | Grizzly Bear | Eland | Cape Buffalo |
|---|---|---|---|---|---|
| Animal Bone | 0.125 | 0.38 | 0.4 | 0.4375 | 0.48 |
| Bone Simulant Insert | 0.125 | 0.4 | 0.4 | 0.4 | 0.5 |

The internal organs of the big game animal comprise the majority of the thickness of the distance for the shoulder to shoulder penetration. Internal organs can not be accurately simulated with ballistic gelatin. A unique series of air and water inserts 600 were constructed to match the appropriate thickness and specific gravity of the internal organs of the desired big game animals.

Figure 7A:
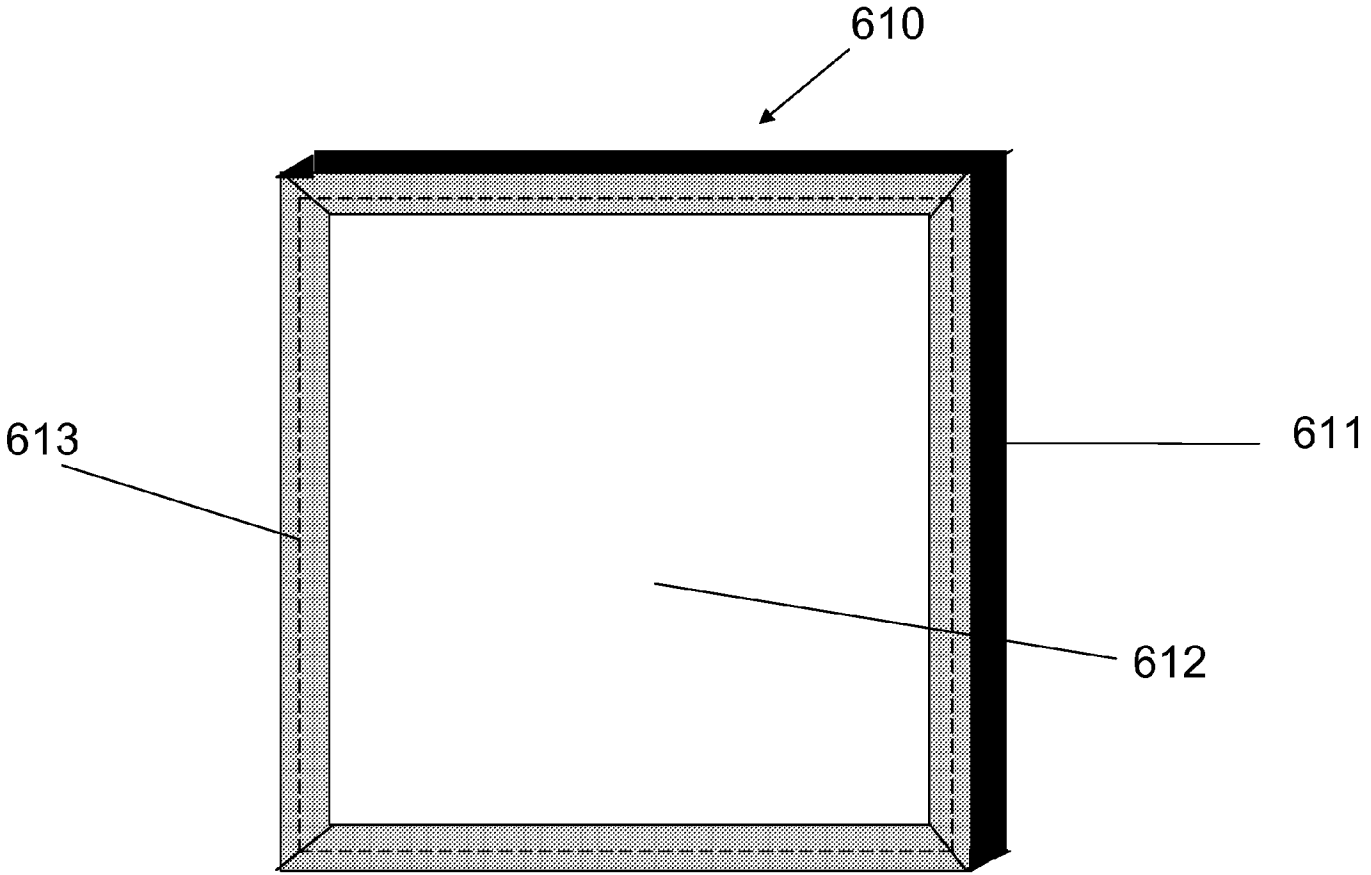
FIGS. 7A and 7B show detailed views of the air insert.
Figure 7B:
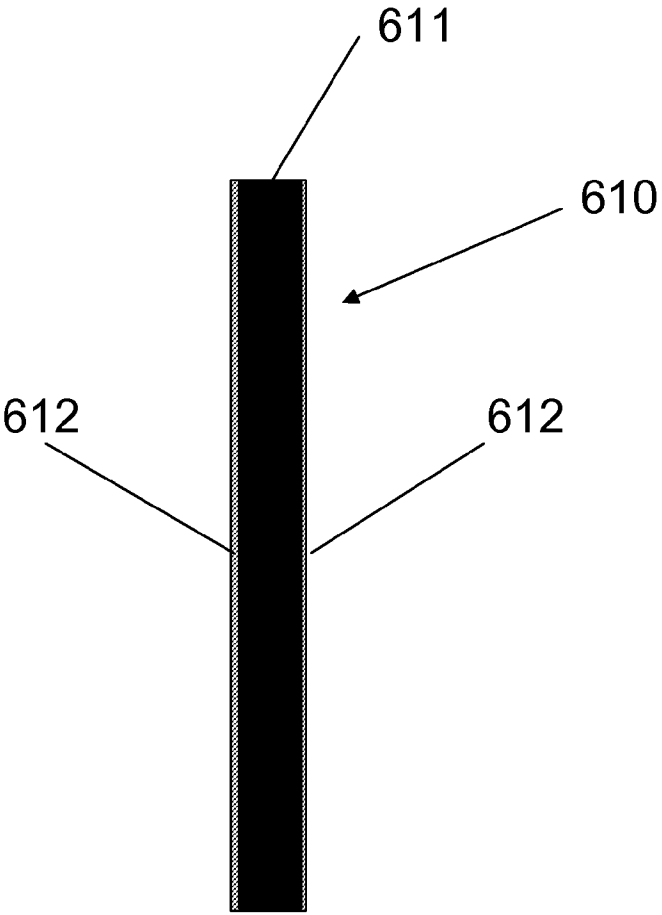
Figure 8:
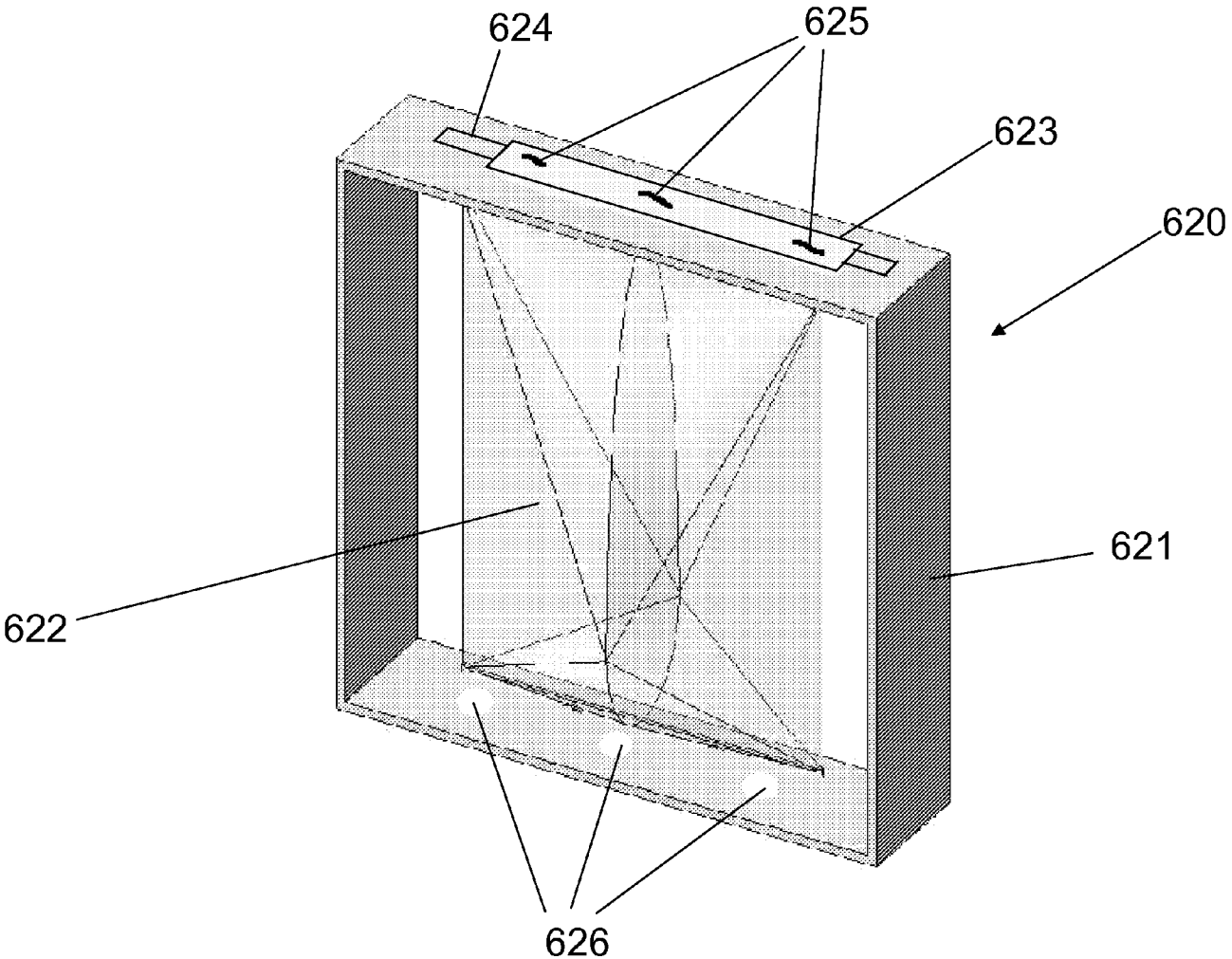
FIG. 8 shows a detailed view of the water insert.

The internal organs are the most difficult to recreate due to heterogeneity. To simulate heterogeneity, the internal organ simulant inserts 600 are comprised of air inserts 610 (FIGS. 7A and 7B) and water inserts 620 (FIG. 8). Air inserts 610 are composed of an air insert frame 611 made from ½" plywood cut into a 15"×15"×2" frame and covered with an air membrane or sheet 612 made of visqueen or polyethylene sheet. The air membrane 612 is attached to the air insert frame 611 by staples 613. Similarly, water inserts 620 are composed of water insert frames 621 made from ½" plywood cut into a 15"×15"×3.5" frame with water bags 622 filled with water or other liquid similar in properties to internal organs. The water bags 622 are vacuum sealed bags and constructed with excess material on one end which acts as a tab 623. The tab 623 is fed through the water bag slot 624 formed into the top of the water insert frame 621 by staples 625. Drainage holes 626 allow for the water to flow away if the bag 622 is penetrated by the projectile. The purpose of vacuum sealing is to guarantee the specific gravity and to reduce the sag in each water bag 622. Water bag 622 dimensions are 11"×14.5" and each is filled with about 1.25 gallons of water to ensure accuracy of the representation. The water inserts 620 and the air inserts 610 may need to be unequal in depth to obtain the proper specific gravity. With the proper geometry and width of the vitals section, each animal can be accurately simulated using these size combinations. Air inserts 610 and water inserts 620 were used in various ratios to obtain a specific gravity of approximately 0.75 which can be seen in Table 4.

TABLE 4

Anatomically Correct Internal Organ Thickness and Description of Required Number of Air Inserts and/or Water Inserts for Internal Organ Analog.

| | Inserts | | | | | | | | Total Length (in) | SG | Anatomic Width |
|---|---|---|---|---|---|---|---|---|---|---|---|
| Whitetail Deer | 3.5" W | 2" A | 3.5" W | | | | | | 9 | 0.78 | 8.5 |
| Eland | 3.5" W | 2" A | 3.5" W | 2" A | 3.5" W | | | | 14.5 | 0.72 | 13 |
| Elk | 3.5" W | 2" A | 3.5" W | 2" A | 3.5" W | 2" A | 3.5" W | | 20 | 0.7 | 20 |
| Grizzly bear | 3.5" W | 2" A | 3.5" W | 3.5" W | 3.5" W | 2" A | 3.5" W | | 21.5 | 0.81 | 22 |
| Cape Buffalo | 3.5" W | 2" A | 3.5" W | 2" A | 3.5" W | 3.5" W | 2" A | 3.5" W | 23.5 | 0.74 | 23 |

Although it may be easier not to use the air insert frame 611 for the air insert 610 in the vitals assembly, it serves multiple purposes. The air insert frame 611 serves as a void between components. It also provides a measurement tool in the case that the projectile does not penetrate completely through the vitals section. Lastly, the air membrane 612 provides a visual representation of the damage pattern left behind by the bullet, and it simulates air pockets in the lungs of an actual animal.

The preferred embodiment of the present invention can be used to accurately recreate any of the five big game animals mentioned previously by placing simulant inserts as listed in Table 5.

TABLE 5

Guidelines for Big Game Animal Replication from Mechanical Analogs for Biologic Materials.

| | Whitetail Deer | Elk | Grizzly Bear | Eland | Cape Buffalo |
|---|---|---|---|---|---|
| Hide Sheets | 4 | 5 | 6 | 5 | 8 |
| Muscle Depth (in) | 0.5 | 1.25 | 1.5 | 1.5 | 2 |
| Bone Depth (in) | 0.125 | 0.4 | 0.4 | 0.4 | 0.5 |
| Internal Organs | 2 Water 1 Air | 4 Water 3 Air | 5 Water 2 Air | 3 Water 2 Air | 5 Water 3 Air |
| Muscle Depth (in) | 0.5 | 1.25 | 1.5 | 1.5 | 2 |
| Bone Depth (in) | 0.125 | 0.4 | 0.4 | 0.4 | 0.5 |
| Hide Sheets | 4 | 5 | 6 | 5 | 8 |

Figure 10:
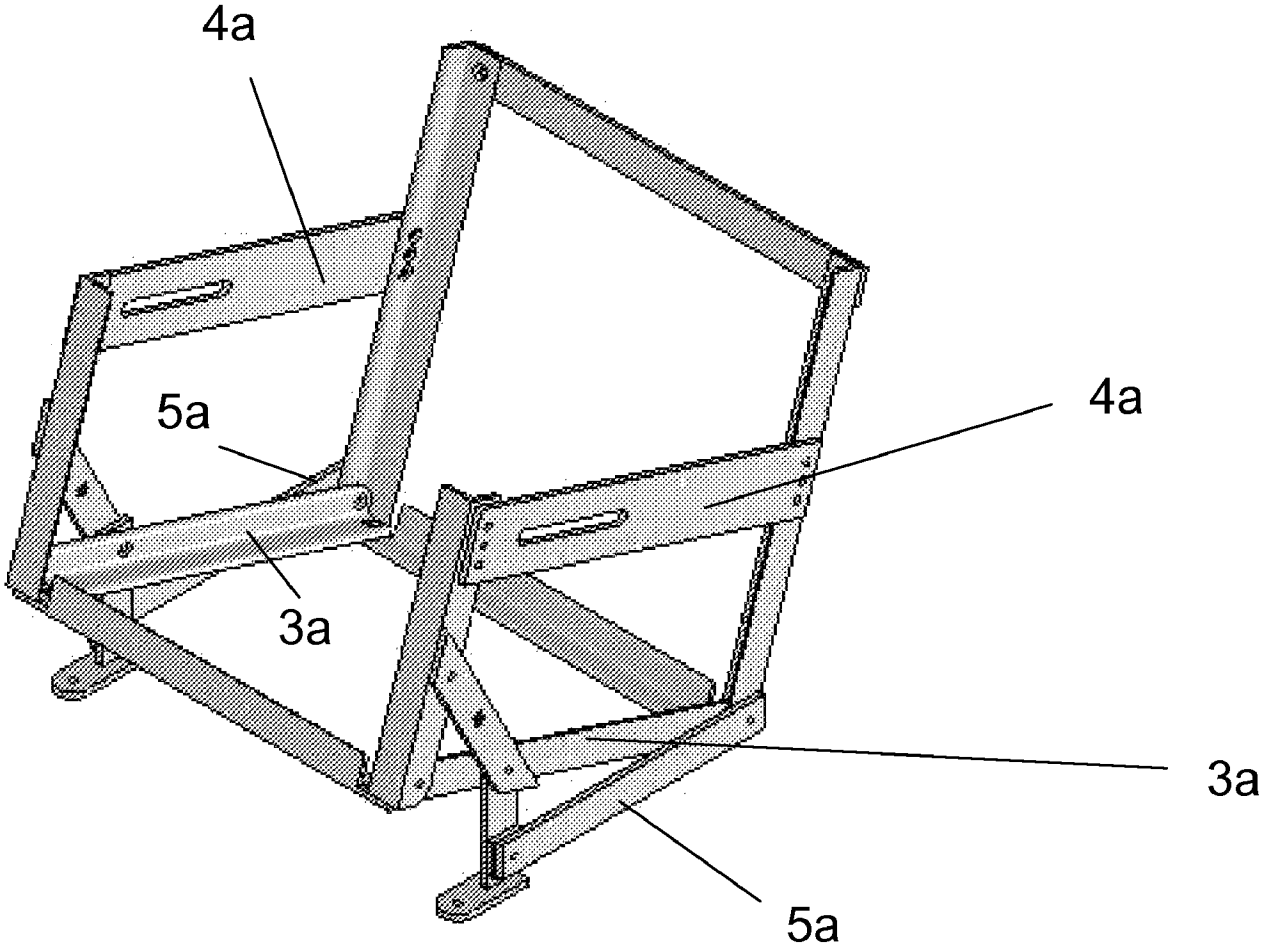
FIG. 10 shows a small frame suitable for smaller game animals.

As depicted in FIG. 10, if the user is only interested in penetration effects on a whitetail deer, the simulator frame 100 can be modified to reduce its length and its weight. This embodiment would entail reducing the length of the bottom rail 3, side rail 4, and side support 5 to 15" by using the whitetail side rail 3*a*, whitetail bottom rail 4*a*, and whitetail side support 5*a*. This frame could also accommodate the smaller insert frames to allow for a less expensive model for experimentation.

In order to test projectile penetration, the present invention is assembled at the testing area by orienting the frame to the firing position as depicted in FIG. 9. Using Table 5 as a guide, the inserts of simulants are placed into the frame 100 in order and quantity as listed. For example, to simulate the anatomic representation of a Cape buffalo, a hide layer with 8 sheets of faux leather is placed at the rear of the frame 100. Then, the muscle simulant insert 400 (in the preferred embodiment a 2" thick layer) of ballistic gelatin is placed in front of the hide simulant insert 300. Next, bone simulant insert 500 (in the preferred embodiment, a ½" layer of fiberglass of the appropriate formulation as previously described) is placed in front of the muscle simulant insert 400. Then a combination of air inserts 610 and water inserts 620 are inserted in order as defined for the preferred embodiment in Table 4. Now, in reverse order as previously described, a bone simulant insert 500, then muscle simulant insert 400, and finally a hide simulant insert 300 are inserted into the frame 100. The locking device 30 is inserted into each of the slots 12 on side rails 4 to rigidly compress the collection of inserts 200. In the preferred embodiment, the locking device adds to the usability of the design by allowing the user to quickly and easily conform the invention to the various game widths. Moving the locking device 30 is carried out by loosening the wing nut 31, which allows the locking device 30 to slide front to back in the slot 12. Then, by tightening the wing nut 31 back down at the proper location to represent the chosen animal, the collection of inserts 200 is locked in place. Finally, a nail or other anchor can be driven into the ground into the hole 13 to rigidly connect the frame 100 to the ground. Now the user can shoot the projectile toward the center of the hide simulant layer 300.

Once the projectile impacts the present invention, the user can observe the rear hide simulant insert 300 to observe if the projectile has penetrated all of the layers of simulants. If complete penetration has not occurred, the user can loosen the wing nut 31 and slide the locking device 30 forward in the slot 12. Now, the process of observing the effect the projectile imparted onto the inserts 200 can begin. Each insert can be removed from the frame 100 and the depth of penetration can be measured. Also the size of the wound cavity can be observed. With this information, the user can compare the effects of various projectile combinations upon the inserts 200 by replacing damaged inserts with new ones.

From the foregoing description, a number of advantages of the present invention become evident. First, one can accurately model the effect of projectile penetration from shoulder to shoulder of a big game animal because all component layers replicate the mechanical properties of the biologic materials. Second, no other penetration modeling device accounts for hide or the internal organs of the target. Also, because the inserts are stacked on each other and rigidly constrained by means of the locking device, it is simple to change the orientation of the inserts for a different animal. For the same reasons, it is easy to remove a layer to observe damage caused by the projectile, and to swap layers once a projectile has penetrated them.

It should also be understood that the present invention can similarly be used for testing of projectile performance for military and law enforcement purposes, inasmuch as the layers may be assembled in a manner to simulate a human torso as well. For example, testing for penetration on ballistics garments (such as so-called "bullet-proof vests") or protective armor can easily be accomplished via the present invention simply by inserting the appropriate protective material in the front of the various simulant layers, namely the hide simulant insert 300. For example, the ballistic material may be attached to a frame 301 in the identical manner described for the hide simulant layer 300 and as illustrated in FIGS. 4A and 4B. Thus, even if the projectile fails to penetrate the ballistic garment material, the effects of its impact may be determined by inspection of the trauma or other deformations to the inserts located behind the ballistic material.

Furthermore, because the frame is constrained to the ground by nails, it will not move upon impact. Because the frame is assembled with bar stock, angle and screws, it is easy to store and ship. Although the assembled model for a Cape buffalo would weigh between 120 and 150 pounds, it is easily transportable because it can be assembled from its parts on site.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A device for simulating the torso of an animal or human to determine projectile performance, comprising:

(a) a support frame; and (b) a plurality of selectively removable simulant inserts, including a hide simulant insert, a muscle simulant insert, a bone simulant insert, and one or more internal organ simulant inserts, and wherein the simulant inserts are placed within the support frame in a predetermined order specific to the type of animal or human being simulated.

2. The device of claim 1, wherein the support frame includes a mounting device to secure the support frame to a ground surface.

3. The device of claim 1, wherein the support frame includes a base adapted to orient the support frame at a selectable angle relative to a projectile path.

4. The device of claim 1, wherein the support frame includes a locking device adapted to secure the simulant inserts to the support frame.

5. The device of claim 4, wherein the locking device includes a fastener slidably disposed within a slot formed in the support frame, and an extended member adapted to contact one of the simulant inserts.

6. The device of claim 1, wherein the hide simulant insert is comprised of one or more sheets of real or imitation leather secured to a hide simulant frame.

7. The device of claim 1, wherein the muscle simulant insert is comprised of ballistic gelatin media.

8. The device of claim 1, wherein the bone simulant insert is comprised of one or more sheets of fiberglass.

9. The device of claim 1, wherein the internal organ simulant inserts are comprised of one or more liquid inserts and one or more air inserts.

10. The device of claim 9, wherein the liquid insert comprises a flexible container containing a liquid, and wherein the flexible container is secured to a liquid insert frame.

11. The device of claim 10, wherein the liquid insert frame includes at least one hole formed therein to permit liquid from the flexible container to flow away from the support frame.

12. The device of claim 9, wherein the air insert comprises an air insert frame having a front side and a back side, and wherein a flexible sheet is secured to the front side and the back side of the air insert frame.

13. The device of claim 1, wherein the simulant inserts within the support frame approximate the width of the animal or human being simulated.

14. The device of claim 1, wherein the average specific gravity of the internal organ simulant inserts approximates the specific gravity of the internal organs of the animal or human being simulated.

15. The device of claim 1, wherein the simulant inserts are placed within the support frame in the following order:

a first hide simulant insert;
a first muscle simulant insert;
a first bone simulant insert;
one or more internal organ simulant inserts;
a second bone simulant insert;
a second muscle simulant insert; and
a second hide simulant insert.

16. The device of claim 15, wherein the internal organ simulant inserts are comprised of one or more liquid inserts and one or more air inserts, and wherein the number and sequence of the liquid inserts and the air inserts are chosen to approximate the specific gravity and width of the animal or human being simulated.

17. The device of claim 1, further including a ballistic garment simulant insert placed in front of the hide simulant insert.

* * * * *